US006101833A

United States Patent [19]

Suzuki

[11] Patent Number: 6,101,833

[45] Date of Patent: Aug. 15, 2000

[54] ICE MAKING MACHINE

[75] Inventor: Yutaka Suzuki, Nagoya, Japan

[73] Assignee: Hoshizaki Denki Kabushiki Kaisha, Aichi, Japan

[21] Appl. No.: 09/334,871

[22] Filed: Jun. 17, 1999

[51] Int. Cl.[7] ..... F25C 1/00

[52] U.S. Cl. ..... 62/340; 249/114.1; 426/322; 426/326; 426/532

[58] Field of Search ..... 426/310, 326, 426/532, 322; 249/114.1; 427/2.24, 2.28, 2.31, 2.3; 62/66, 340

[56] References Cited

U.S. PATENT DOCUMENTS 3,959,199 5/1976 Mandel ..... 260/28.5 R
5,085,873 2/1992 Degre ..... 426/8
5,176,930 1/1993 Kannankeril et al. ..... 426/124
5,573,801 11/1996 Wilhoit ..... 426/326
5,976,593 11/1999 Ruzek ..... 426/281
5,980,826 11/1999 Barenberg et al. ..... 426/326

*Primary Examiner*—William E. Tapolcai
*Attorney, Agent, or Firm*—Koda & Androlia

[57] ABSTRACT

A plurality of freezing cells opening downwardly are defined like a grid in a freezing chamber of an injection type ice making machine. The freezing chamber, which is made of a metal having good thermal conductivity, is coated on the surface with a material containing a substance having an antibacterial substance. Contaminant-free ice cubes are adapted to be formed by the thus formed coating layer. As a material of this coating layer, a melt of tin (96.5%) and silver (3.5%) can be suitably used.

5 Claims, 5 Drawing Sheets

ICE MAKING MACHINE

BACKGROUND OF THE INVENTION

1. Field of the Invention

The present invention relates to an ice making machine, and more particularly, to an ice making machine, in which a surface or surfaces of an ice making section are covered with a material having an antibacterial property.

2. Description of the Related Art

Automatic ice making machines for continuously manufacturing cubic-shaped ices, ice sheet of predetermined thickness, flake-shaped ice pieces or the like in large quantity are properly used depending upon application in various industrial fields. Known as the ice making machines for manufacturing cubic ice pieces are injection type ice making machines, for example, (1) so-called closed cell type ones, in which a multiplicity of cubic-shaped freezing cells partitioned in a freezing chamber to open downwardly are free to be closed from below by a water pan, and an ice making water is injected into the respective freezing cells from the water pan so as to gradually make cubic ice pieces in the freezing cells, and (2) open cell type ones, in which an ice making water is supplied directly into a multiplicity of cubic-shaped freezing cells opening downwardly so as to grow cubic ice pieces in the freezing cells. Further, ice making machines for continuously manufacturing sheet ice and small pieces of crush ice, and auger type ice making machines for continuously manufacturing flake-shaped ice pieces have been put into practice.

In former various kinds of ice making machines, an ice making section where ice bodies such as cubic ice pieces, sheet ice and the like are formed is generally made of a metal having good thermal conductivity, and surfaces thereof are tin plated. Such tin plating is carried out for prevention of corrosion of metals so that tin itself does not possess any antibacterial property and bactericidal effect. More specifically, although the possibility wherein various kinds of bacteria mixed in raw water used for ice making increase during ice making operation is very few, there is a danger of ice bodies containing such various bacteria being manufactured. Further, in a type of ice making machines where an ice making water is circulated, there is a problem in terms of hygiene because it is adequately possible that various bacteria increase under high temperature conditions after the ice making operation is stopped.

SUMMARY OF THE INVENTION

In view of the disadvantage described above, the present invention has been proposed to suitably solve said disadvantage, and has its object to provide an ice making machine capable of manufacturing hygienic ice bodies by the virtue of covering a surface or surfaces of an ice making section with a material having an antibacterial property.

To overcome the above problem and to suitably attain the intended object, the present invention provides an ice making machine for producing ice bodies in an ice making section adapted to be cooled by an evaporator communicating to a refrigeration system, the improvement wherein a surface or surfaces of the ice making section are coated with material containing a substance having an antibacterial property.

DETAILED DESCRIPTION OF THE PREFERRED EMBODIMENTS

An ice making machine according to the present invention will be described below by way of preferred embodiments with reference to the accompanying drawings.

First Embodiment

Figure 1:
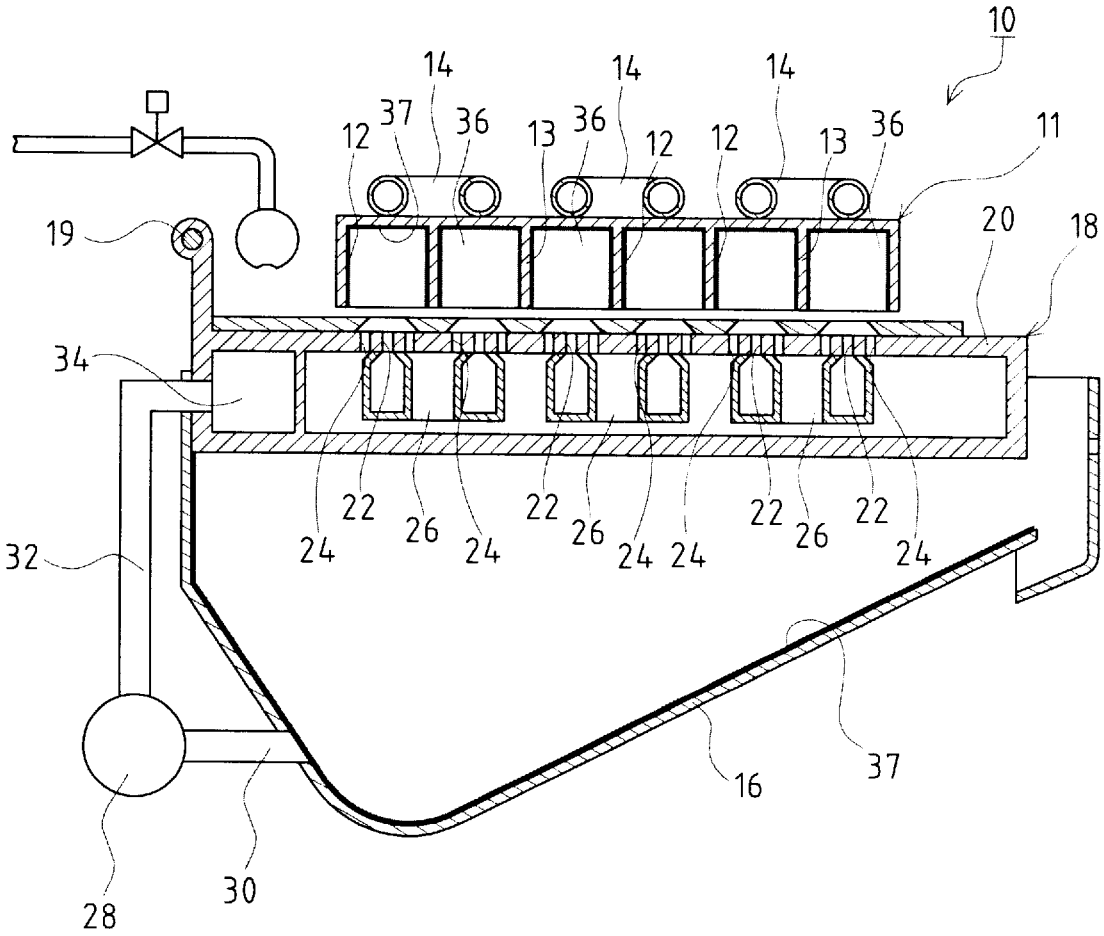
FIG. 1 is a longitudinal cross sectional view showing a schematic constitution of an injection type ice making machine according to a first embodiment of the present invention.

FIG. 1 shows an injection type ice making machine 10 according to a first embodiment of the present invention. An ice making mechanism in the ice making machine 10 comprises a freezing chamber 11 serving as an ice making section and provided horizontal in an upper area of a housing, and a plurality of freezing cells 12 opening downwardly partitioned like a grid by a multiplicity of partitions 13, which are provided crosswise on an underside of the freezing chamber 11. Further, an evaporator 14 communicated to a refrigeration system (not shown) is arranged closely on a top surface of the freezing chamber 11 in a zigzag fashion so that a refrigerant is circulated in the evaporator 14 to forcedly cool the freezing cells 12 during an ice making operation and a high temperature refrigerant gas (hereinafter referred to as "hot gas") is circulated therein during an ice removing operation to heat the freezing cells 12.

A water pan 18 provided with a water tank 16, which serves as a water storage section for storing a predetermined amount of ice making water, is provided immediately below the freezing chamber 11 to be inclinedly pivoted by a support shaft 19 provided at one end thereof. The water pan 18 is positioned horizontal during the ice making operation to be maintained in parallel to the freezing chamber 11 and is biased by an inclining mechanism (not shown) during an ice removing operation to be moved obliquely about the support shaft 19 in clockwise direction in the drawing to be stopped in an inclined position, thereby opening the freezing cells 12.

A flat plate section 20 of a predetermined thickness to close all the freezing cells 12 during the ice making operation is formed on a top surface portion of the water pan 18 opposed to the freezing chamber 11, and the flat plate section 20 is formed with a multiplicity of injection holes 22, which act to inject the ice making water against the respective freezing cells 12, and a multiplicity of return holes 24, 24, which are disposed adjacent to the injection holes 22 to recover an unfrozen water into the water tank 16. Water supply pipes 26 are arranged on an underside (back surface) of the flat plate section 20 to have openings at its upper portions matching with the respective injection holes 22, so that it is communicated to the holes spatially. Further, a pump 28 is provided on a side of the water tank 16 to pumpingly draw the ice making water through a suction pipe 30 communicated to the water tank 16 to pressure feed the water to a pressure chamber 34, provided on the water pan 18, through a discharge pipe 32 shown in the drawing. Then, the ice making water pressure fed to the pressure chamber 34 is injected and supplied into the respective freezing cells 12 via the multiplicity of injection holes 22 and the respective water supply pipes 26.

The freezing chamber 11 in the ice making machine 10 is formed from a metal having good thermal conductivity, a surface of the metal being coated with a material containing a substance having an antibacterial property, so that a coating layer 37 permits formation of ice cubes 36, in which various bacteria are not mixed. In addition, the coating layer 37 suffices to be applied only on at least inner surfaces of the freezing cells 12 but may be applied on the entire surfaces of the freezing cells. As the material of the coating layer 37, for example, a melt of tin (96.5%) and silver (3.5%) can be suitably used. Incidentally, the mixing ratio of tin and silver suffices to adequately exhibit bactericidal effects, so that it is not limited to the above-mentioned proportion. Further, for example, "Zeomic" (trade name) manufactured by Shinanen Inc. is suitably used for the bactericidal agent, and may be mixed in tin at a desired ratio to provide a material for use in coating.

Function of First Embodiment

The injection type ice making machine according to the first embodiment will be described with respect to the function thereof. When an operation of the ice making machine 10 is started, the pump 28 is driven to inject and supply the ice making water stored in the water tank 16 into the freezing cells 12 via the injection holes 22. Because the freezing cells 12 has been cooled below the freezing point through operation of the refrigeration system prior to injection and supplying of the ice making water, a part of the ice making water begins to freeze on inner wall surfaces of the freezing cells 12 in layered fashion. Further, unfrozen water falls through the return holes 24, 24 in the water pan 18 to be recovered into the water tank 16.

The ice making water injected and supplied into the freezing cells 12 is brought into contact with the coating layer 37 whereby various bacteria existent in the water are reduced by the virtue of the antibacterial property and bactericidal effect possessed by the coating layer 37. Accordingly, as the ice making operation proceeds, contaminant-free hygienic ice cubes (ice bodies) 36 are formed in the freezing cells 12. When a suitable detecting means detects formation of finished ice cubes 36, it issues an ice making completion signal to stop the ice making operation. Subsequently, an ice removing operation is started by switchover of valve discs such that the hot gas is supplied to the evaporator 14 to heat the entire freezing chamber 11, thereby melting freezing between the inner wall surfaces of the freezing cells 12 and ice cubes 36. Then, the water pan 18 is inclined at a desired timing to open the lower openings of the freezing cells 12, during which the hot gas continuously supplied gradually melts freezing between the inner wall surfaces of the freezing cells 12 and ice cubes 36. Thus, the ice cubes 36 fall by their own weight from the freezing cells 12 to fall slidingly on the water pan 18 in an obliquely downward direction to be stored in an ice storage bin (not shown).

In addition, a further antibacterial effect can be expected in the injection type ice making machine 10 by applying the coating layer 37 on surfaces of the water pan 18, inner surfaces of the water tank 16 (see FIG. 1) or inner surfaces of the suction pipe 30 and discharge pipe 32, inner surfaces of the water supply pipes 26 communicated and connected to an interior of the water pan 18 or the like, in addition to the freezing chamber 11.

Second Embodiment

Figure 2:
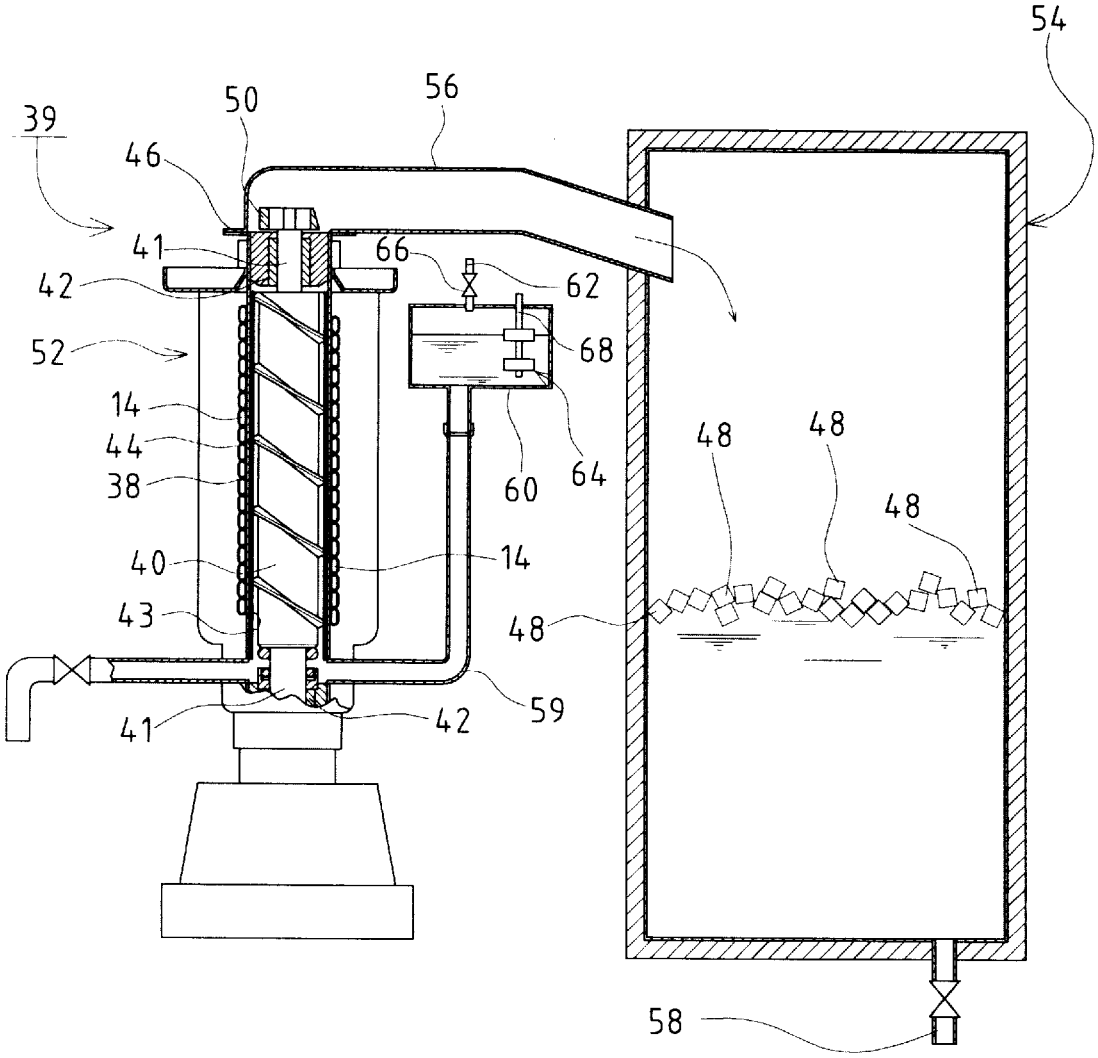
FIG. 2 is a longitudinal cross sectional view showing a schematic constitution of an auger type ice making machine according to a second embodiment of the present invention.

FIG. 2 shows an auger type ice making machine according to a second embodiment of the present invention. The auger type ice making machine 39 is constructed such that an evaporator 14 communicated to a refrigeration system (not shown) is wound closely around the outer periphery of a cylindrical-shaped freezing casing 38, which serves as an ice making section, and a refrigerant is circulated in the evaporator 14 during an ice making operation to forcedly cool the freezing casing 38. An auger 40 is inserted into the freezing casing 38 and a shaft 41 extending from upper and lower ends of the auger is rotatably supported by bearings 42, 42 provided at the upper and lower ends of the freezing casing 38. The auger 40 is formed with a cutting blade 44, which has an outer diameter slightly smaller than an inner diameter of the freezing casing 38 and is formed to be cylindrical and spiral in shape, so that thin ice pieces (ice bodies) frozen on inner wall surfaces of the freezing casing 38 are scraped off by the cutting blade 44 to be conveyed upward. The inner surfaces of the freezing casing 38 are coated with a material containing a substance having an antibacterial property, so that the coating layer 43 permits formation of thin ice pieces, in which various bacteria are not mixed.

A pressing head 46 serving also as a bearing for the auger 40 is provided on a top portion of the freezing casing 38 to compress thin ice pieces, which are scraped off by the cutting blade 44 to be conveyed upward, to form compressed ice. The compressed ice formed by the pressing head 46 is cut to a predetermined size by a cutter 50 provided on an upper portion of the pressing head 46 to make compressed ice pieces 48 having a desired size. Arranged on a top of an ice making mechanism 52 comprised of the freezing casing 38 and the auger 40 is an ice discharge passage 56 communicated to an ice storage bin 54 disposed adjacent to the ice making mechanism 52 whereby a multiplicity of compressed ice pieces 48 manufactured by the ice making mechanism 52 are discharged into the ice storage bin 54 via the ice discharge passage 56. The ice storage bin 54 is provided at its bottom with a drain pipe 58 so that water to be produced when the compressed ice pieces 48 formed and cut to a desired size melt with the passage of time can be drained. Further, a pipe body 59 for supplying of the ice making water to the freezing casing 38 is communicated and connected to a lower portion of the freezing casing 38, and the other end of the pipe body 59 is communicated to a float tank 60 shown in the drawing. The float tank 60 is provided with a feed water pipe 62 connected to an outside city water system, and a float switch 64 provided in the float tank 60 controls opening and closing of a feed water valve 66 incorporated into the feed water pipe 62 to maintain a water level of the ice making water stored in the float tank 60.

With the auger type ice making machine constructed above, the ice making water is fed to the float tank 60 through the feed water pipe 62, and when the water level rises to reach an upper limit switch 68 of the float switch 64 provided in the float tank 60, the feed water valve 66 closes to stop supplying of the ice making water. At this time, if the ice making operation is started, the freezing casing 38 is cooled by heat exchange with the refrigerant, which circulates in the evaporator 14, so that the ice making water fed to the freezing casing 38 from the float tank 60 begins to gradually freeze first on inner wall surfaces of the casing to form thin layered pieces. As described above, because the coating layer 43 having an antibacterial property is formed on the inner wall surfaces of the freezing casing 38, various bacteria existent in the ice making water decrease for formation of hygienic thin ice pieces. As the auger 40 provided in the freezing casing 38 is rotatably driven, the cutting blade 44 on the auger 40 scrapes off thin ice pieces to convey them upward, so that contaminant-free hygienic compressed ice pieces 48 are manufactured.

In addition, with respect to the auger type ice making machine, it is recommended that the coating layer 43 be similarly applied on inner peripheral surfaces of the auger 40 and the cutting blade 44 in addition to the inner wall surfaces of the freezing casing 38. Further, it is possible to effect antibacterial treatment on the ice making water stored by applying the coating layer 43 on inner wall surfaces of the float tank 60 and inner surfaces of the pipe body 59.

Third Embodiment

Figure 3:
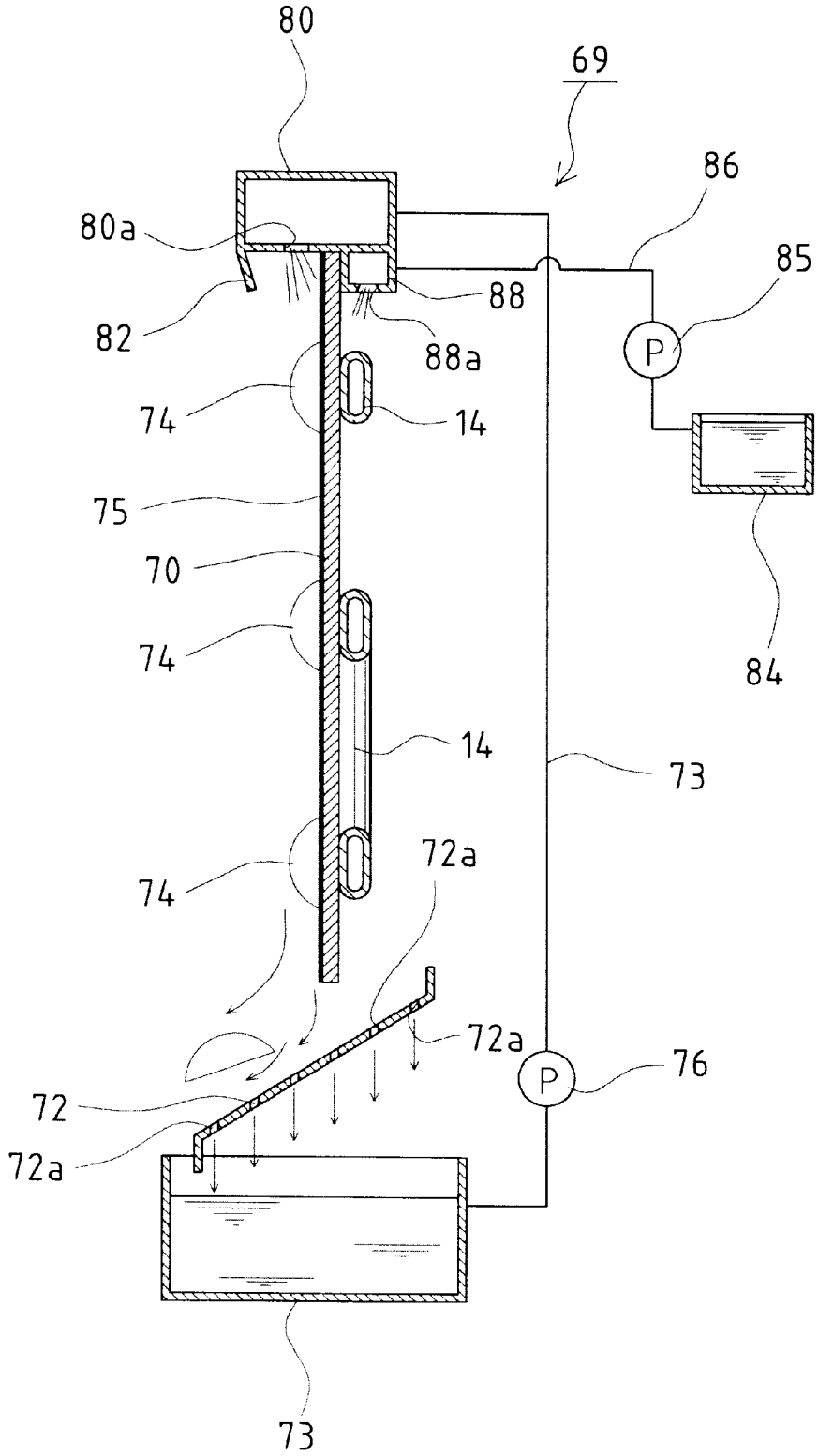
FIG. 3 is a longitudinal cross sectional view showing a schematic constitution of a flow down type ice making machine according to a third embodiment of the present invention.

FIG. 3 shows a flow down type ice making machine according to a third embodiment of the invention. In the ice making machine 69, an evaporator 14 communicated to a refrigeration system (not shown) is arranged closely on a back surface side of an ice making plate 70, which is positioned vertical and serves as an ice making section, in a zigzag fashion so that a refrigerant is circulated in the evaporator 14 to cool the ice making plate 70 below the freezing point. In addition, a water collecting plate 72 formed with a plurality of through holes 72*a* is disposed inclinedly immediately below the ice making plate 70, whereby the ice making water supplied to the ice making plate 70 during an ice making operation falls through the through holes 72*a* to be recovered into and stored in a water tank 73 disposed below as a water storage section. Further, the water collecting plate 72 functions to guide ice pieces (ice bodies) 74, which are scraped off to fall during an ice removing operation, into an ice storage chamber (not shown) arranged obliquely downwardly of the water collecting plate 72. An ice making surface of the ice making plate 70 is coated with a material containing a substance having an antibacterial property, so that the coating layer 75 permits formation of ice pieces 74, in which various bacteria are not mixed.

A water circulation pump 76 is connected to the water tank 73, and a water supplying pipe 78 connected to a discharge side of the pump 76 is connected to a water spray 80 arranged above the ice making plate 70. The water spray 80 is formed with a multiplicity of spray holes 80*a*, which extend lengthwise of the spray, whereby the ice making water pressure fed from the water tank 73 is made to flow down the ice making surface of the ice making plate 70 via the spray holes 80*a* and a deflection guide 82 to thereby form ice pieces 74 on the ice making surface during the ice making operation.

Further, the ice making machine 69 is provided with an ice removing water supplying system separately from the above-mentioned ice making water supplying system. More specifically, a pump 85 is connected to an ice removing water tank 84 provided in the ice making machine, and an ice removing water feed pipe 86 communicated to a discharge side of the pump 85 is connected to an ice removing water spray 88 arranged above the ice making plate 70. The ice removing water pressure fed from the water tank 73 in the ice removing operation is made to flow down the back side of the ice making plate 70 via the multiplicity of spray holes 88*a* formed in the ice removing water spray 88 to melt frozen surfaces on the ice making plate 70 and the ice pieces 74. Further, the ice removing water having flowed down the back side of the ice making water is recovered into the water tank 73 via the through holes 72*a* formed in the water collecting plate 72 in the same manner as the ice making water.

In the flow down type ice making machine 69 constructed above, because the ice making surface of the ice making plate 70, to which the ice making water flows to be supplied, is coated with the coating layer 75, various bacteria existent in the ice making water decrease by the virtue of the antibacterial property and bactericidal effect possessed by the coating layer 75. Accordingly, contaminant-free hygienic ice pieces 74 are formed on the ice making plate 70. In addition, the coating layer 75 may be applied on all the portions of the ice making water supplying system or the ice removing water supplying system in addition to the water tank 73, the water supplying pipe 78 and so on.

Fourth Embodiment

Figure 4:
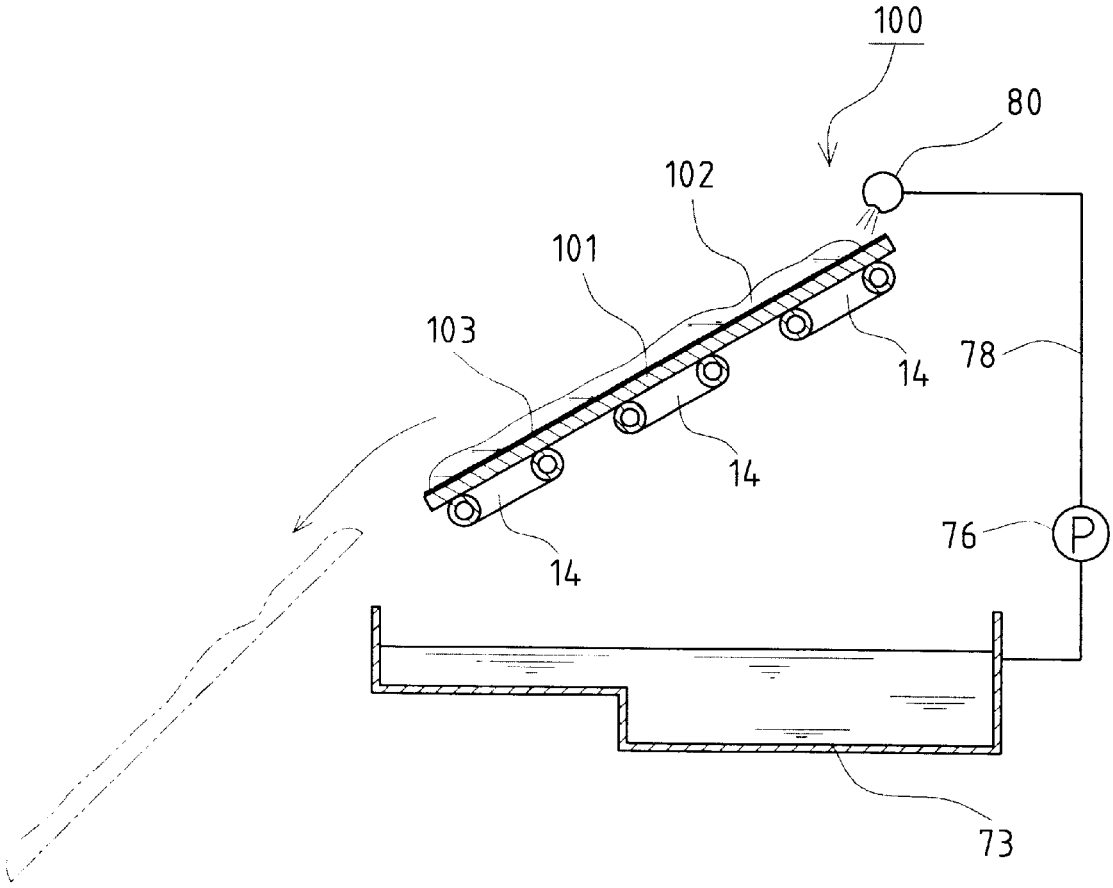
FIG. 4 is a longitudinal cross sectional view showing a schematic constitution of a plate type ice making machine according to a fourth embodiment of the present invention.

FIG. 4 shows a plate type ice making machine. The ice making machine 100 is essentially the same in constitution as the above-mentioned flow down type ice making machine 69, but is different from the latter in that an ice making plate 101 is positioned obliquely so as to form a single ice sheet (ice body) 102 on an ice making surface of the ice making plate 101. With the plate type ice making machine 100, the ice making surface of the ice making plate 101 is coated with a coating layer 103 so as to form a contaminant-free hygienic ice sheet 102. Further, it is recommended that other parts, in which the ice making water circulates, than the ice making plate 101 be coated with a coating layer 103. Be noted that other constituent members of the plate type ice making machine 100 are designated by the same reference numerals as those of the corresponding members of the flow down type ice making machine 69.

Fifth Embodiment

Figure 5:
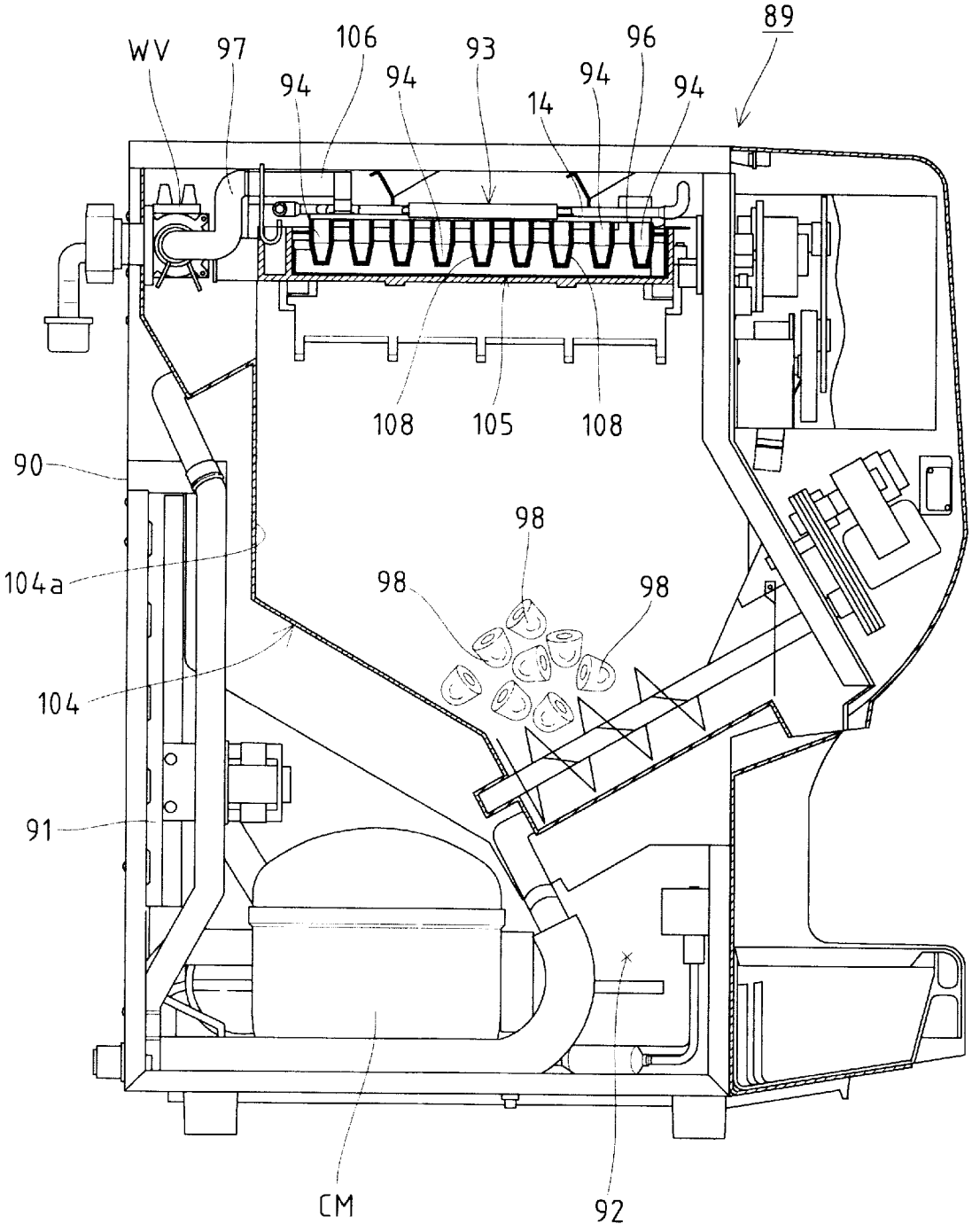
FIG. 5 is a longitudinal cross sectional view showing a schematic constitution of an immersion type ice making machine according to a fifth embodiment of the present invention.

FIG. 5 shows an immersion type ice making machine. The immersion type ice making machine 89 essentially comprises, as shown in the drawing, a lower machine room 92 receiving therein a refrigerating machine such as a compressor CM, a condenser 91 and so on, a box-shaped ice storage bin 104 disposed above the lower machine room, enclosed by a heat insulating material and defining therein an ice storage chamber 104*a*, and an ice making unit 93 arranged in an upper area of the ice storage bin 104. The ice making unit 93 essentially comprises a water pan 105 serving as a water storage section for storing the ice making water at a predetermined level, and an ice making base plate 96 provided with ice making projections 94, which serve as an ice making section and are adapted to be immersed in the ice making water. The ice making base plate 96 is turnably inserted into a through hole provided in a bracket (not shown), which is hangingly supported in an upper area of the ice storage bin 104. A feed water pipe 106 for the ice making water is detachably provided on the ice making base plate 96 to be properly positioned, and a feed water valve WV connected to the feed water pipe via a supply pipe 97 is opened at a timing of the ice making operation to permit a predetermined amount of ice making water to be supplied to the water pan 105.

Further, an evaporator 14 extending from the refrigerating system received in the lower machine room 92 is disposed on an upper surface of the ice making base plate 96 in a zigzag fashion. During the ice making operation, the ice making projections 94 are immersed in the ice making water stored in the water pan 105 at a predetermined level. In this state, the refrigerating system is operated to make heat exchange with the evaporator 14 through the ice making base plate 96, with the result that the ice making projections 94 are cooled to be maintained at 0° C. or lower to thereby form lumps of ice (ice bodies) 98 around the ice making projections 94. Surfaces of the ice making projections 94 are coated with the above-mentioned material containing a substance having an antibacterial property, so that the coating layer 108 permits formation of lumps of ice 98, in which various bacteria are not mixed.

With the immersion type ice making machine 89 constructed above, because the surfaces of the ice making projections 94 immersed in the water pan 105 are coated with the coating layer 108, various bacteria existent in the ice making water decrease by the virtue of the antibacterial property and bactericidal effect possessed by the coating layer 108. Accordingly, contaminant-free hygienic lumps of ice 98 are formed on the ice making projections 94. Incidentally, in the immersion type ice making machine 89, application of the coating layer 108 on the inner surfaces of the water pan 105 and the inner surfaces of the feed water pipe 106 can suppress propagation of various bacteria.

What is claimed is:

1. An ice making machine for producing ice bodies in an ice making section adapted to be cooled by an evaporator communicating to a refrigeration system, the improvement wherein a surface or surfaces of the ice making section are coated with material containing a substance having an antibacterial property.

2. The ice making machine according to claim 1, wherein said material is tin incorporated with silver at a predetermined proportion.

3. The ice making machine according to claim 1, wherein an ice making water stored in a water storage section is circulated in and supplied to said ice making section to form the ice bodies in said ice making section.

4. The ice making machine according to claim 1, wherein the ice making section is immersed in the ice making water stored in a water storage section to form the ice bodies in said ice making section.

5. The ice making machine according to claim 3 or 4, wherein an inner surface or surfaces of the water storage section are coated with the material containing the substance having the antibacterial property.

* * * * *